US005325080A

United States Patent [19]

Chandratilleke et al.

[11] Patent Number: 5,325,080

[45] Date of Patent: Jun. 28, 1994

[54] SUPERCONDUCTING COIL APPARATUS AND METHOD OF MANUFACTURING THE SAME

[75] Inventors: Rohana Chandratilleke; Hideaki Maeda, both of Yokohama, Japan

[73] Assignee: Kabushiki Kaisha Toshiba, Kawasaki, Japan

[21] Appl. No.: 795,674

[22] Filed: Nov. 21, 1991

[30] Foreign Application Priority Data

Nov. 21, 1990 [JP] Japan ..... 2-318406

[51] Int. Cl.[5] ..... H01F 1/00; H01F 7/06; H01B 12/00

[52] U.S. Cl. ..... 335/216; 505/705; 505/879; 505/211

[58] Field of Search ..... 335/216; 505/704, 705, 505/879

[56] References Cited

U.S. PATENT DOCUMENTS 4,675,636 6/1987 Kawaguchi ..... 335/216

FOREIGN PATENT DOCUMENTS 0387072 9/1990 European Pat. Off. .
0012711 2/1981 Japan ..... 505/879
0137605 10/1981 Japan ..... 335/216
57-48203 3/1982 Japan ..... 335/216
57-48204 3/1982 Japan ..... 335/216
57-48205 3/1982 Japan ..... 335/216
0063809 4/1982 Japan ..... 505/879
0064911 4/1982 Japan ..... 505/879
0075406 5/1982 Japan ..... 335/216
0041121 9/1986 Japan ..... 505/879
0271804 12/1986 Japan ..... 335/216
0229905 10/1987 Japan ..... 335/216
250608 11/1990 Japan .
4120705 4/1992 Japan ..... 335/216

OTHER PUBLICATIONS

Y. Iwasa et al., The Effect on Stability of Frictional Decoupling For a Composite Superconductor, Proceedings of the 8th Symposium on Engineering Problems of Fusion Research, vol. III, IEEE Pub. No. 79CH1441-5 NPS, Nov. 1979, pp. 1407-1411.

Patent Abstracts of Japan, vol. 7, No. 166, (E-188), Jul. 21, 1983, & JP-A-58 073 104, May 2, 1983, Shimamoto Susumu, et al., "Superconductive Magnet".

Patent Abstracts of Japan, vol. 13, No. 312, (E-788), Jul. 17, 1989, & JP-A-1 084 603, Mar. 29, 1989, Koizumi Misao, "Superconducting Electromagnet Device".

Patent Abstract of Japan, vol. 6, No. 119, (E-116)(997), Jul. 3, 1982, & JP-A-57 48 203, Mar. 19, 1982, Tooru Saima, et al., "Superconductive Electromagnet".

*Primary Examiner*—Leo P. Picard
*Assistant Examiner*—Stephen T. Ryan
*Attorney, Agent, or Firm*—Oblon, Spivak, McClelland, Maier & Neustadt

[57] ABSTRACT

A superconducting coil apparatus comprises a cryostat, a superconducting coil body contained in a cryostat and including a surface portion of an epoxy resin layer, and an interposing member interposed between the resin layer of the superconducting coil body and the cryostat and including a block with a through-hole, a thermal barrier member and a friction-reducing member interposed between the block and the heat barrier member. The thickness of that portion of the surface portion of the superconducting coil body, which contacts the interposing member, is set in a range of 0.4 mm to 3.5 mm, and the thickness of the other portion of the surface portion is set to less than 0.4 mm.

15 Claims, 13 Drawing Sheets

SUPERCONDUCTING COIL APPARATUS AND METHOD OF MANUFACTURING THE SAME

BACKGROUND OF THE INVENTION

1. Field of the Invention

The present invention relates to a superconducting coil apparatus, such as a levitating force supplying superconducting on-board coil apparatus for a magnetically levitating train, and a method of manufacturing the coil apparatus.

2. Description of the Related Art

This type of superconducting coil apparatus comprises a cryostat having a racetrack-shaped container, a racetrack-shaped resin-impregnated superconducting coil body contained in the container, and a plurality of members (fixing members) interposed between the superconducting coil body and the cryostat and having a function of allowing a coolant to flow between the superconducting coil body and the inner surface of the cryostat and a function of fixing the superconducting coil body within the cryostat.

By virtue of the fixing members, a very-low-temperature coolant (typically, helium) is let to flow through the space defined by the inner surfaces of the cryostat and the peripheral surfaces of the superconducting coil body and the superconducting coil body is cooled below the superconducting critical temperature.

This type of superconducting coil apparatus is manufactured in the following manner. A superconducting coil body is obtained by solidifying a superconducting coil bundle with a resin. The superconducting coil bundle is obtained by subjecting a superconducting wire or insulating material to predetermined processing. Specifically, the superconducting wire, which is obtained by coating a superconducting core with copper or other stabilizing material, is wound a necessary number of times in a racetrack shape with thin insulating layers interposed, thus forming the superconducting coil bundle. The superconducting coil bundle is impregnated with epoxy resin. By hardening the resultant structure, a composite superconducting coil body is obtained.

The superconducting coil body is contained in a racetrack-shaped space of a cryostat. Thereafter, a plurality of members (fixing members) are interposed between the superconducting coil body and the cryostat. The fixing members has a function of allowing a coolant to flow between the superconducting coil body and the cryostat and a function of fixing the superconducting coil body within the cryostat.

The above-described conventional superconducting coil apparatus has the following problem. In the conventional apparatus, a resin layer of uniform thickness is formed on the surface portion of the superconducting coil body. A part of the resin layer contacts the fixing member, and most the rest contacts the coolant. When the superconducting coil body is energized, electromagnetic force acts on the coil body so as to make the coil body circular. The fixing members and the superconducting coil body tend to be displaced from each other by the electromagnetic force. In this case, even if the degree of displacement is about several-tens of μm, frictional heat occurs at an interface between the fixing members and the coil body. At very low temperatures such as at liquid helium temperature, the specific heat of substances is extremely low. Thus, the generated frictional heat tends to be conducted to the superconducting wire adjacent the resin layer of the surface portion.

If the temperature of the superconducting wire is raised to a normal conducting transition temperature by the frictional heat, a quench occurs. In order to prevent frictional heat from being easily transmitted to the superconducting wire, it is necessary to thicken the resin layer constituting the surface portion, thereby increasing the heat resistance and dispersing the heat widely. On the other hand, when the superconducting coil body is energized or deenergized or when the coil body is mounted on a magnetically levitated train, an eddy current loss and hysteresis loss occur and consequently heat occurs in the superconducting coil body. It is necessary to quickly transmit the internally generated heat to the coolant via the resin layer constituting the surface portion. If the temperature of the superconducting wire is raised to the normal conducting transition temperature by the internal heat, a quench occurs. In order to quickly transmit the internal heat, it is necessary to make the resin layer thin and sufficiently reduce the heat resistance of the resin layer.

As can be seen from the above, in order to prevent the quench due to frictional heat, it is necessary to thicken, as much as possible, the resin layer constituting the surface portion. In addition, in order to prevent the quench due to internally generated heat, it is necessary to make the resin layer thin as much as possible. It is therefore necessary to meet these contradictory requirements. In the conventional superconducting coil, the resin layer constituting the surface portion of the superconducting coil body is made to have a uniform thickness. If one requirement is met, the other is not met; both requirements cannot be met.

SUMMARY OF THE INVENTION

The object of the present invention is to provide a superconducting coil apparatus and a method of manufacturing the same, which can prevent both a quench due to frictional heat generated at an interface between a superconducting coil body and a member for fixing the coil body to a cryostat and a quench due to internally generated heat, without making the construction of the apparatus complex.

This object can be achieved by a superconducting coil apparatus comprising:

a cryostat;

a superconducting coil body contained in the cryostat and including an outer surface portion of a resin layer having a thick portion and a thin portion; and an interposing member interposed between the thick portion of the resin layer and the cryostat and having a function of flowing a coolant between the superconducting coil body and the cryostat and a function of fixing the superconducting coil body within the cryostat.

The object can also be achieved by a superconducting coil apparatus comprising:

a cryostat;

a superconducting coil body contained in the cryostat and including a surface portion of a resin layer of a uniform thickness;

a block having one end portion fixed to the cryostat and having a function of flowing a coolant between the superconducting coil body and the cryostat and a function of fixing the superconducting coil body within the cryostat; and a member fixed at one end to the surface portion of the superconducting coil body and supporting, at the other end, the other end portion of the block, said member having substantially the same characteristics as said surface portion.

The object can also be achieved by a method of manufacturing a superconducting coil apparatus, comprising the steps of:

subjecting a superconducting wire and an insulating material to a predetermined processing, thus forming a superconducting coil bundle;

subjecting the superconducting coil bundle to a curable resin impregnation treatment and a curing treatment, thus forming a pure superconducting coil body having a uniform-thickness resin layer on said superconducting coil body;

subjecting the resin layer of the pure superconducting coil body to a shaping process, thus forming a superconducting coil body including a surface portion having a thick portion and a thin portion on the outer surface of the superconducting coil body;

placing the superconducting coil body in a cryostat; and interposing, between the thick portion of the superconducting coil body and the cryostat, an interposing member having a function of allowing a coolant to flow between the superconducting coil body and the cryostat and a function of fixing the superconducting coil body within the cryostat.

The object can also be achieved by a method of manufacturing a superconducting coil apparatus, comprising the steps of:

subjecting a superconducting wire and an insulating material to a predetermined processing, thus forming a superconducting coil bundle;

subjecting the superconducting coil bundle to a curable resin impregnation treatment and a curing treatment, thus forming a superconducting coil body having an outer surface portion of a resin layer with a thick portion and a thin portion;

placing the superconducting coil body in a cryostat; and interposing, between the thick portion of the superconducting coil body and the cryostat, an interposing member having a function of flowing a coolant between the superconducting coil body and the cryostat and a function of fixing the superconducting coil body within the cryostat.

The object can also be achieved by a method of manufacturing a superconducting coil apparatus, comprising the steps of:

subjecting a superconducting wire and an insulating material to a predetermined processing, thus forming a superconducting coil bundle;

subjecting the superconducting coil bundle to a curable resin impregnation treatment and a curing treatment, thus forming a superconducting coil body having an outer surface portion of a uniform-thickness resin layer on the superconducting coil body;

placing the superconducting coil body in a cryostat;

fixing, to the cryostat, an end portion of a block having a function of allowing a coolant to flow between the superconducting coil body and the cryostat and a function of fixing the superconducting coil body within the cryostat; and fixing, to the surface portion of the superconducting coil body, one end portion of a member having substantially the same characteristics as said surface portion, and having the other end portion of the member supported on the other end portion of the block.

According to the present invention, the thickness of that portion of the resin layer constituting the surface portion of the superconducting coil body, which contacts he interposing member directly or indirectly, is greater than the thickness of the other portion of the resin layer. Thus, the thick portion functions to increase heat resistance and disperse the heat widely, thereby preventing the temperature rise of the superconducting wire. When the thick portion is formed of an epoxy resin layer or a glass fiber-reinforced epoxy resin layer, it is sufficient to set the thickness of the thick portion in a range of 0.4 mm to 3.5 mm. The thickness of the other portion can be sufficiently reduced. Therefore, in this other portion, internally generated heat can quickly be transmitted to a coolant.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
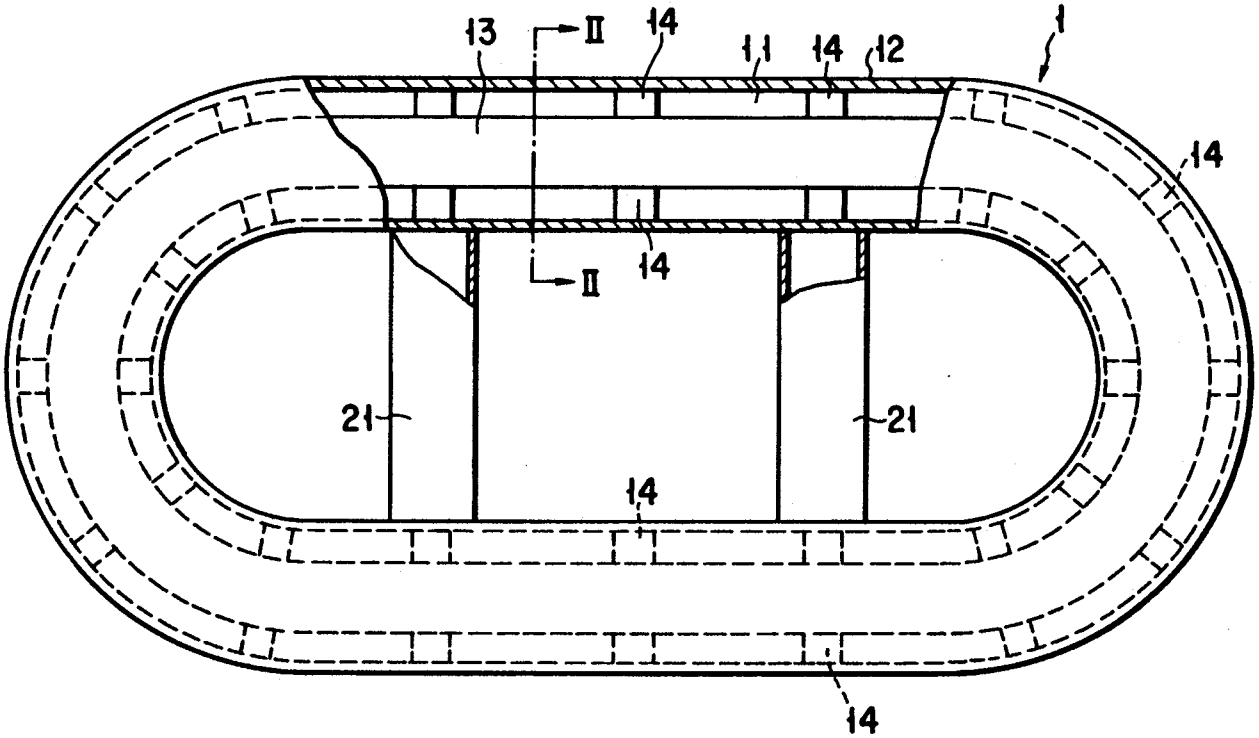
FIG. 1 is a partially cut-out side view of superconducting coil apparatus according to the first embodiment of the present invention.

FIG. 1 shows schematically the structure of a superconducting coil apparatus according to a first embodiment of the present invention. The superconducting coil apparatus according to the first embodiment is, typically, a levitating force supplying superconducting coil apparatus mounted on a magnetically levitated train.

The superconducting coil apparatus 1 of FIG. 1 comprises a cryostat having a racetrack-shaped container 12, a superconducting coil body 13, a plurality of fixing members 14 serving as interposing members, and coolant supply means (not shown). The apparatus 1 further includes power leads and a persistant current switch (both not shown) for leading the two ends of a superconducting coil 13 to the outside of the cryostat 12.

The cryostat 12 has a racetrack-shaped space 11. In FIG. 1, only the inner tank of the cryostat, which is made of a non-magnetic metal such as stainless steel, is shown. An outer tank, not shown, exists outside the cryostat 12. A vacuum insulated space (not shown) is provided to surround the shown inner tank of cryostat 12. The vacuum insulated space is provided between the inner tank and the outer tank. Reinforcing members 21 are provided to reinforce the outer surface of the inner wall of the inner tank. The outer tank and the vacuum insulated space are not directly related to the present invention, and therefore these elements are not shown.

Figure 3:
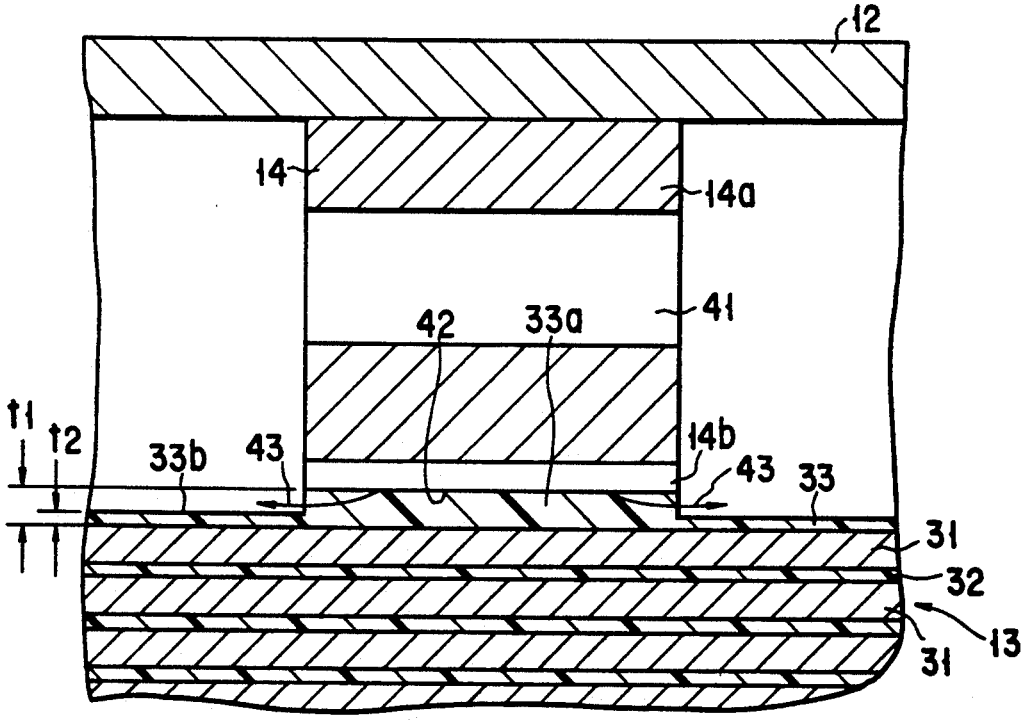
FIG. 3 is a cross-sectional view taken along line III—III in FIG. 2.

The superconducting coil body 13 is a racetrack-shaped structure impregnated with resin. The body 13 is contained in the space 11 in the cryostat 12. The superconducting coil body 13 is obtained by solidifying a superconducting coil bundle with resin. That is, the superconducting coil bundle is obtained by subjecting superconducting wires and insulating material to a predetermined process. As shown in FIG. 3, the superconducting coil bundle is formed by winding a superconducting wire 31 with a thin insulating layer 32 a predetermined number of times in a racetrack shape. The superconducting wire 31 is formed by coating a Nb-Ti alloy-based superconducting wire core with copper or other stabilizing material. The superconducting coil bundle is impregnated with epoxy resin or epoxy resin containing glass fibers as reinforcing material. The resultant structure is solidified, and a composite superconducting coil body 13 is obtained.

Figure 2:
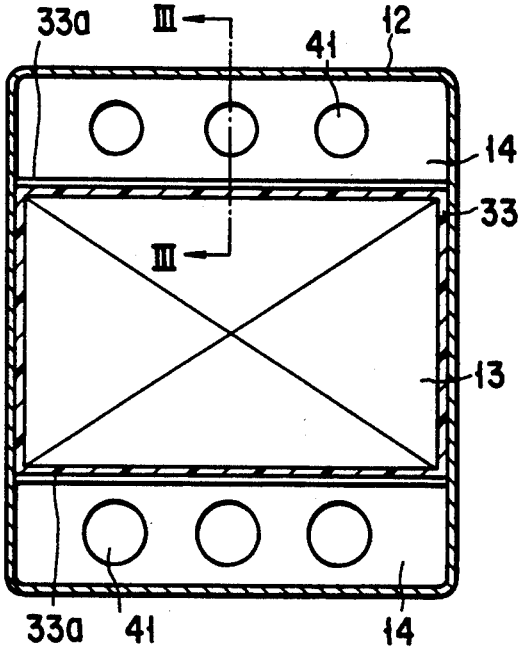
FIG. 2 is a cross-sectional view taken along line II—II in FIG. 1.

In the above embodiment, as shown in FIGS. 2 and 3, a resin layer 33 is exposed on the surface portion of the superconducting coil body 13 to the coolant. The exposed resin layer 3 is formed by adjustment in the process of resin impregnation, processing after solidification, or adhesion of a resin plate. As shown in FIG. 3, the thickness t1 of the portion 33*a* of the resin layer 33, which directly contacts the fixing member 14, is greater than the thickness t2 of the portion 33*b* which does not directly contact the fixing member 14. Specifically, t1 is in the range 0.4 mm to 3.5 mm and t2 is less than 0.4 mm (e.g. 0.2 mm).

The fixing member 14 or interposing member has a function of allowing a coolant to flow in the space of the superconducting coil body 13, inner wall of the cryostat 12. The fixing member 14 has another function of fixing the superconducting coil body 13 within the cryostat 12. A plurality of fixing members 14 are interposed, with a predetermined distance, between the inner and outer peripheral surfaces of the superconducting coil body 13, on one hand, and the inner surfaces of the inner and outer walls of the cryostat 12, on the other. The fixing members 14 are arranged in pairs, each comprising a fixing member situated outside the superconducting coil body 13 and a fixing member situated inside the body 13, each facing the other. Each fixing member 14 comprises a block 14*a* of non-magnetic stainless steel and a spacer 14*b* of fiber-reinforced plastic (FRP) material. Each fixing member 14 is mounted between the inner surface of the cryostat 12 and the portion 33*a* with thickness t1 of the resin layer 33 constituting the surface portion of the superconducting coil body 13. The block 14*a* has a plurality of through-holes 41 extending in the direction of superconducting wire 31, through which holes 41 the coolant.

The coolant supply means (not shown) supplies a coolant such as liquid helium to the space defined by the presence of the fixing members 14 between the inner surfaces of the inner and outer walls of the cryostat 12, on one hand, and the inner and outer peripheral surfaces of the superconducting coil body 13.

In the above structure, when liquid helium or coolant is introduced into the cryostat 12, the liquid helium flows in the circumferential direction, passing through the through-holes of the blocks 14*a* successively. The superconducting coil body 13 is cooled by liquid helium below the superconducting critical temperature.

When the superconducting coil body 13 is excited in this state, a high electromagnetic force is generated in the superconducting coil body 13 so as to cause the coil body 13 to have a circular shape. Once the fixing members 14 and superconducting coil body 13 are displaced from one another by the electromagnetic force, frictional heat generates at an interface 42 between the fixing members 14 and the superconducting coil body 13. The frictional heat tends to be transmitted to the superconducting wire 31 through the resin layer 33 constituting the surface portion. If the heat raises the temperature of the superconducting wire 31 to a normal conduction transition temperature, a quench occurs. In this embodiment, however, the thickness of the portion 33*a* of the resin layer 33 constituting the surface portion of the superconducting coil body 13, which directly contacts the fixing member 14, is set to in the range 0.4 to 3.5 mm. In general, frictional heat is a heat pulse having a pulse duration of several msec milliseconds. Since the thickness of the portion 33*a* is set to this value, the heat pulse height become reduced other the pulse reach the superconducting wire 31 through the portion 33*a*. As a result, the temperature rise of the superconducting wire 31 situated at the surface portion is prevented. As shown in FIG. 3 by solid-line arrows 43, a part of the generated frictional heat can be transmitted to liquid helium via end faces of the portion 33*a*. Thus, the transmission of frictional heat generated at the interface 42 to the superconducting wire 31 situated at the surface portion can be prevented, and a quench due to frictional heat generated at the interface 42 can be avoided.

On the other hand, when the superconducting coil body 13 is energized or de-energized, or when the body 13 is mounted, for example, on a magnetically floating train, an eddy current loss and hysteresis loss occur and consequently heat generates in the superconducting coil body 13. It is necessary to quickly transmit the internally generated heat to liquid helium through the resin layer 33 constituting the surface portion. If the temperature of the superconducting wire 31 is raised by the internal heat to the normal conducting transition temperature, a quench occurs. In this embodiment, however, the resin layer 33 constituting the surface portion is designed such that the thickness t2 of the portion 33*b* which directly contacts liquid helium is 0.2 mm and very small. Thus, the heat resistance of the portion 33*b* is very low and the internal heat can quickly be transmitted to liquid helium. As a result, a quench due to internally generated heat can be prevented.

Figure 4:
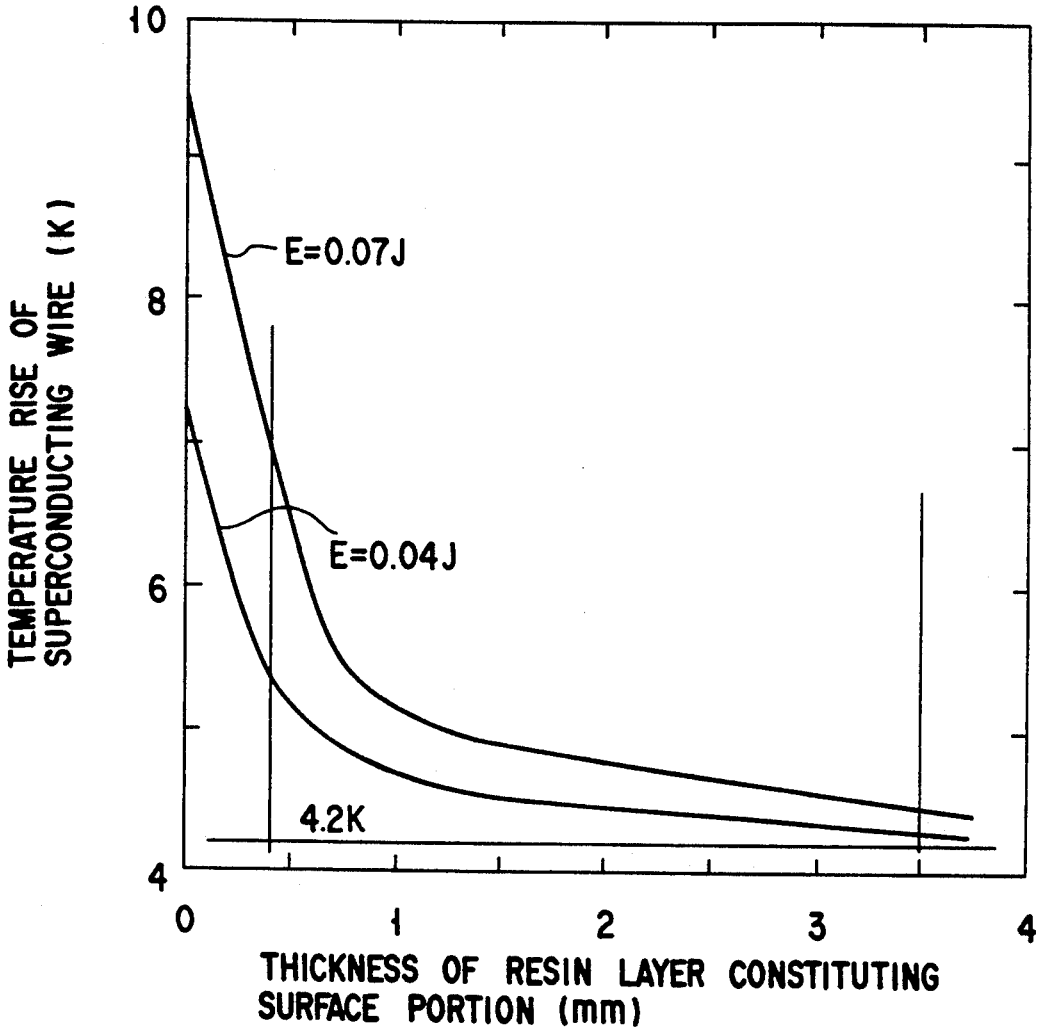
FIG. 4 shows a relationship between the thickness of a resin layer constituting a surface portion of the superconducting coil body and the frictional heat transmission prevention effect.

The thickness t1 of the portion 33*a* may be increased, thereby preventing the frictional heat of the interface 42 from being transmitted to the superconducting wire 31. If the thickness of the portion 33*a* is increased, however, the internal heat generated in the superconducting coil body 13 cannot quickly be transmitted to liquid helium, and consequently a quench may occur. If the thickness t1 is increased more than required, adverse effects can occur such as epoxy cracking and beboud-ing. FIG. 4 shows results of calculations conducted by the present inventor, on the temperature rise suppression effect in relation to the incoming frictional heat. The abscissa indicates thickness t1 of the portion 33*a*, and the ordinate the temperature rise of the superconducting wire 31. The calculations were made under the condition that the portion 33 are made of epoxy resin and portion 33 is in contact with liquid helium of 4.2 K. In the case where the incoming frictional heat amount E is 0.07 J, the temperature of the superconducting wire 31 situated on the surface portion rises to 9.4 K when the thickness t1 is 0. In accordance with the increase in thickness t1, the temperature rise of the superconducting wire 31 lowers. However, as can be seen from FIG. 4, where the thickness t1 is 1 mm or more, the increase rate of temperature rise prevention effect becomes less effective. Considering the functional heat, it is desirable to set the thickness t1 of the portion 33*a* is set to about 3.5 mm at maximum. On the other hand, supposing that the temperature rise of the superconducting wire 31 situated on the surface portion is reduced to half the value obtainable when t1=0, t1 is 0.4 mm and the minimum value is about 0.4 mm. Thus, if t1 is set in a range of 0.4 mm to 3.5 mm and t2 is set to about 0.2 mm, as in the above embodiment, both the quench due to frictional heat and the quench due to internally generated heat can be prevented.

Figure 5:
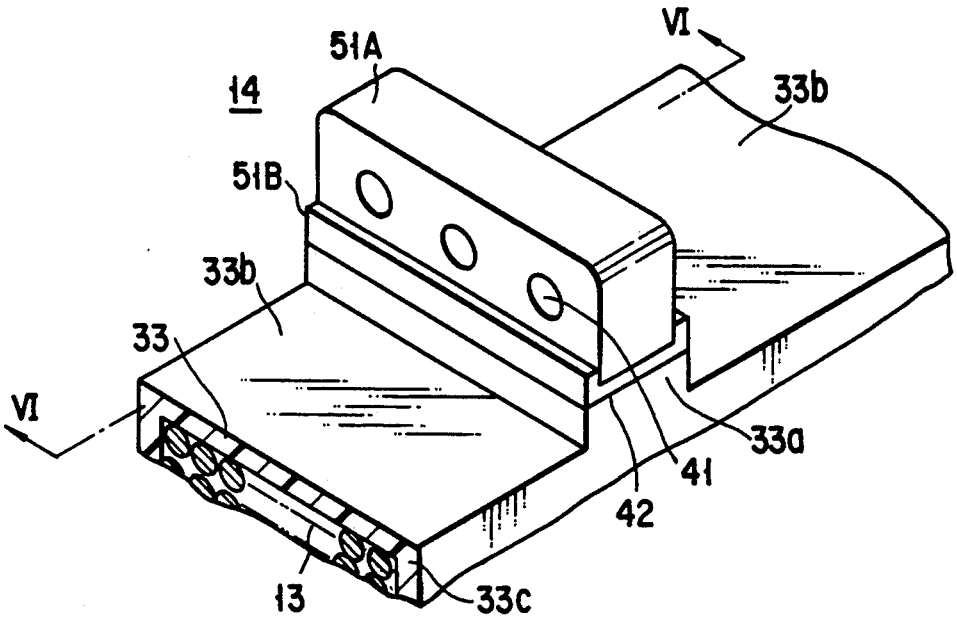
FIG. 5 is a perspective view showing locally an important portion of a superconducting coil apparatus according to a modification of the first embodiment of this invention.
Figure 6:
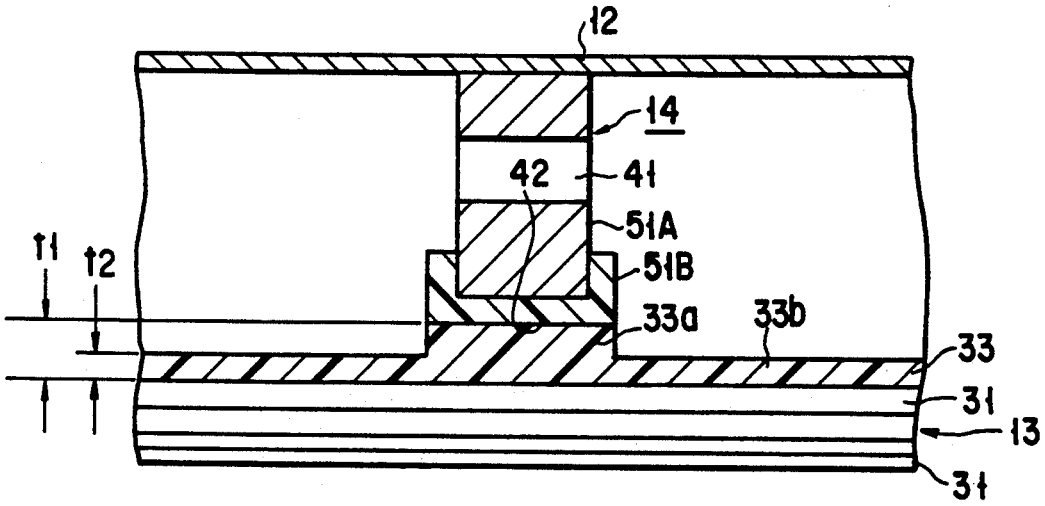
FIG. 6 is a cross-sectional view taken along line VI—VI in FIG. 5.

FIGS. 5 and 6 show an important portion of a superconducting coil apparatus according to a modification of the first embodiment of the invention. In FIGS. 5 and 6, the same structural elements as shown in FIGS. 2 and 3 are denoted by like reference numerals, and a detailed description thereof is omitted.

In the modification of the first embodiment, a fixing member 14 comprising a block 51A and a spacer 51B are employed. A resin layer 33 constituting the surface portion of a superconducting coil body 13 is designed such that the thickness of its portion 33*a* supporting the fixing member 14 is set in the range of 0.4 mm to 3.5 mm and the thickness of portion 33*b* directly contacting a coolant and the thickness of a side portion 33*c* are set to less than 0.4 mm. The spacer 51B made of fiber-reinforced plastic (FRP) in a C-cross section, which engages the block 51A, is interposed between the portion 33*a* and the fixing member 14.

With the above structure, the same effect as in the above embodiment can be obtained.

Figure 7:
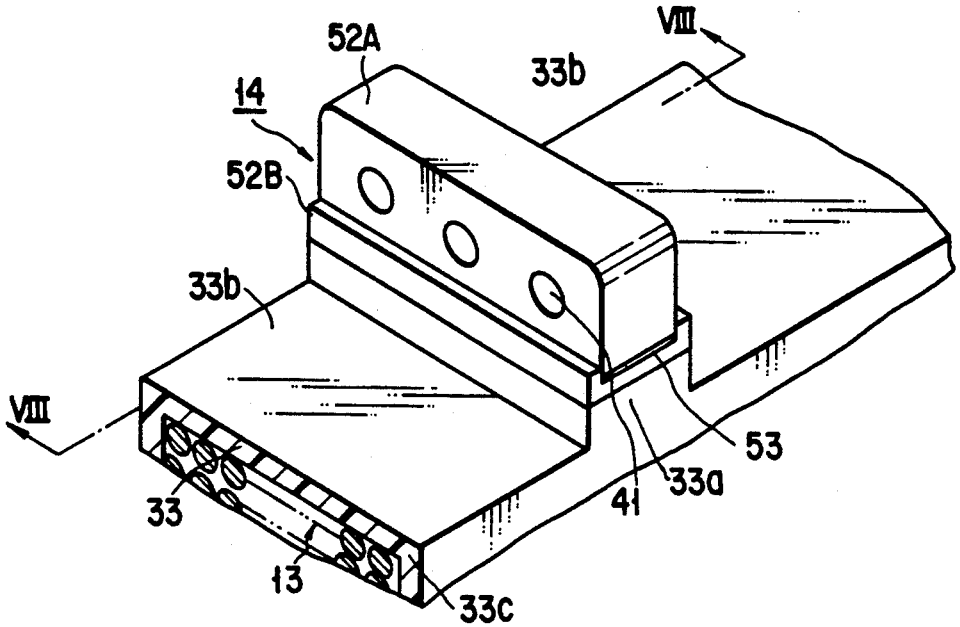
FIG. 7 is a perspective view showing locally an important portion of a superconducting coil apparatus according to a second embodiment of the invention.
Figure 8:
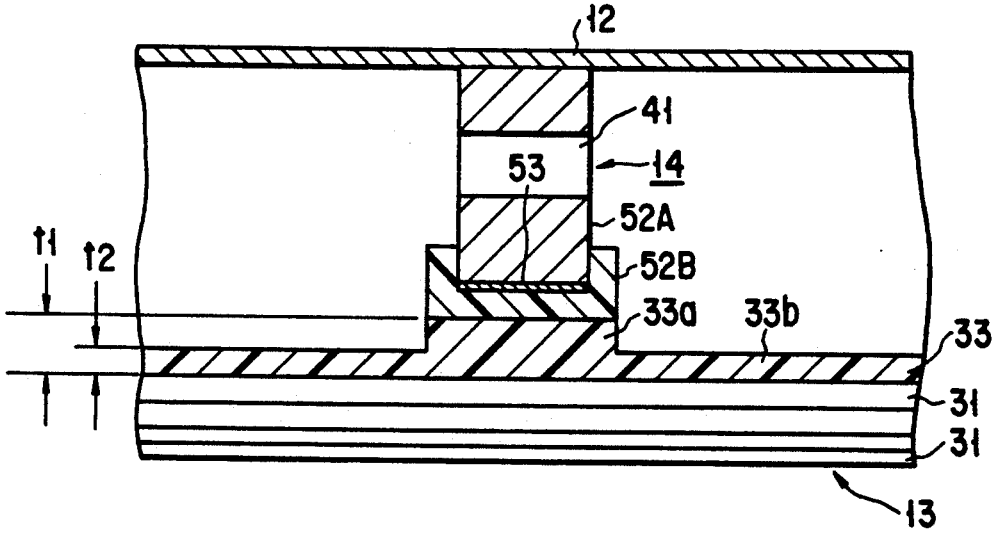
FIG. 8 is a cross-sectional view taken along line VIII—VIII in FIG. 7.

FIGS. 7 and 8 show an important portion of the superconducting coil apparatus according to the second embodiment of the invention. In FIGS. 7 and 8, the same structural elements as shown in FIGS. 2 and 3 are denoted by like reference numerals, and a detailed description thereof is omitted.

In the second embodiment, a fixing member 14 comprising a block 52A, a heat barrier member 52B and low-friction sheet 53 is employed. A resin layer 33 constituting a surface portion of a superconducting coil body 13 is designed such that the thickness of a portion 33*a* directly contacting a coolant and the thickness t2 of a side portion 33*c* are set to less than 0.4 mm. The portion 33*a* supporting the fixing member 14 is designed to be slightly thick such that this portion 33*a* protrudes from the resin layer. The heat barrier member 52B is fixed on the outer surface of the portion 33*a* with an adhesive. The heat barrier member 52B is formed of an epoxy plate a glass fiber-reinforced epoxy plate or a bakelite plate in a C-cross section so as to be engageable with the block 52A. A solid lubricating member or low-friction sheet 53 is interposed between the heat barrier member 52B and the block 52A. In this embodiment, the total thickness t1 of the portion 33*a* and thermal barrier member 52B is set in a range of 0.4 mm to 3.5 mm.

With the above structure, the same advantage as in the preceding embodiment can be obtained, and, in addition, the frictional heat can be suppressed by the presence of the solid lubricating member or low-friction sheet 53.

Figure 9:
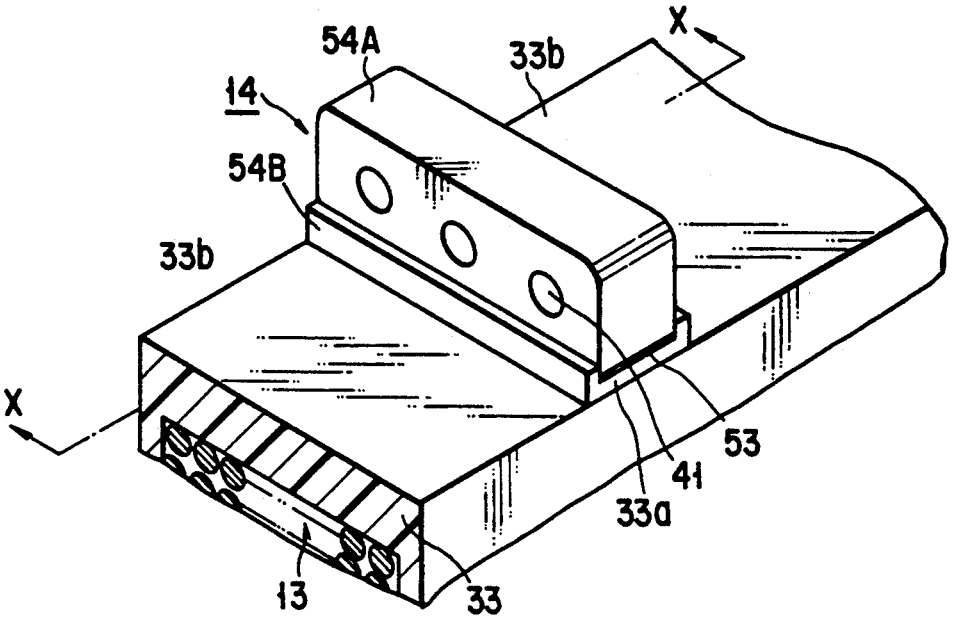
FIG. 9 is a perspective view showing locally an important portion of a superconducting coil apparatus according to a third embodiment of the invention.
Figure 10:
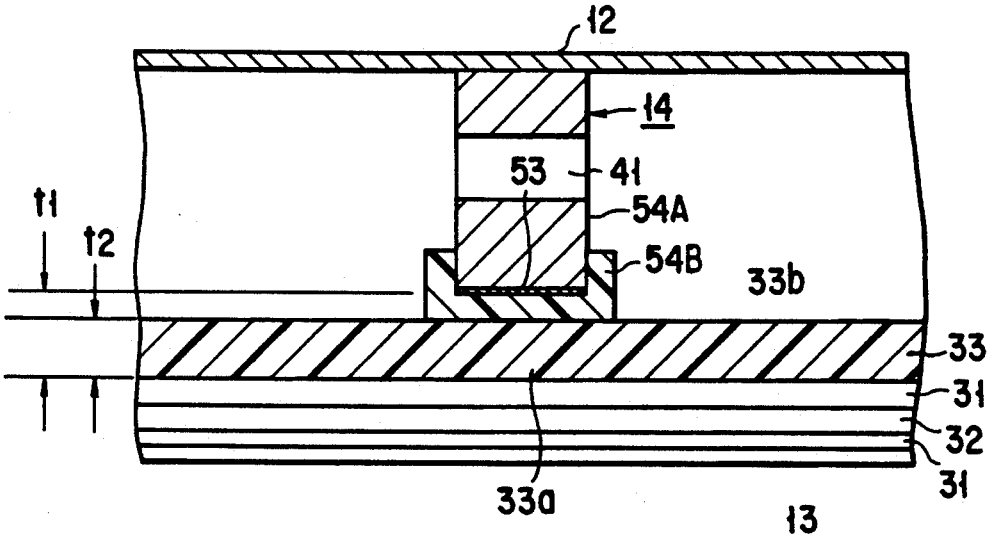
FIG. 10 is a cross-sectional view taken along line X—X in FIG. 9.

FIGS. 9 and 10 show an important portion of the superconducting coil apparatus according to the third embodiment. In FIGS. 9 and 10, the same structural elements as shown in FIGS. 2 and 3 are denoted by like reference numerals, and a detailed description thereof is omitted.

In the third embodiment, a fixing member 14 comprising a block 54A, a heat barrier member 54B and a low-friction sheet 53 is employed. When the superconducting coil body 13 is manufactured, the thickness t2 of a resin layer 33 constituting a surface portion is set to less than 0.4 mm uniformly. Then, a thermal barrier member 54B is fixed on the portion supporting the fixing member 14 with an adhesive. The heat barrier member 54B is formed of an epoxy plate, a glass fiber-reinforced epoxy plate or a bakelite plate in a C-cross section so as to be engageable with the fixing member 14. Thus, a portion 33*a* of the resin layer 33 is obtained. A solid lubricating member or low-friction sheet 53 is interposed between the heat barrier member 54B and the block 54A. In this embodiment, too, the thickness t1 of the portion 33*a* including the thickness of the heat barrier member 54B is set in the range of 0.4 mm to 3.5 mm.

With the above structure, the same advantage as in the second embodiment shown in FIGS. 7 and 8 is obtained. Besides, since there is no need to provide steps on the resin layer 33 constituting the surface portion at the time of manufacturing the superconducting coil body 13, the manufacture can be simplified.

In the second embodiment shown in FIGS. 7 and 8, the thick portion 33*a* is formed by adhering the C-cross sectional heat barrier member by using an adhesive, thereby forming the thick portion 33*a*.

Figure 11:
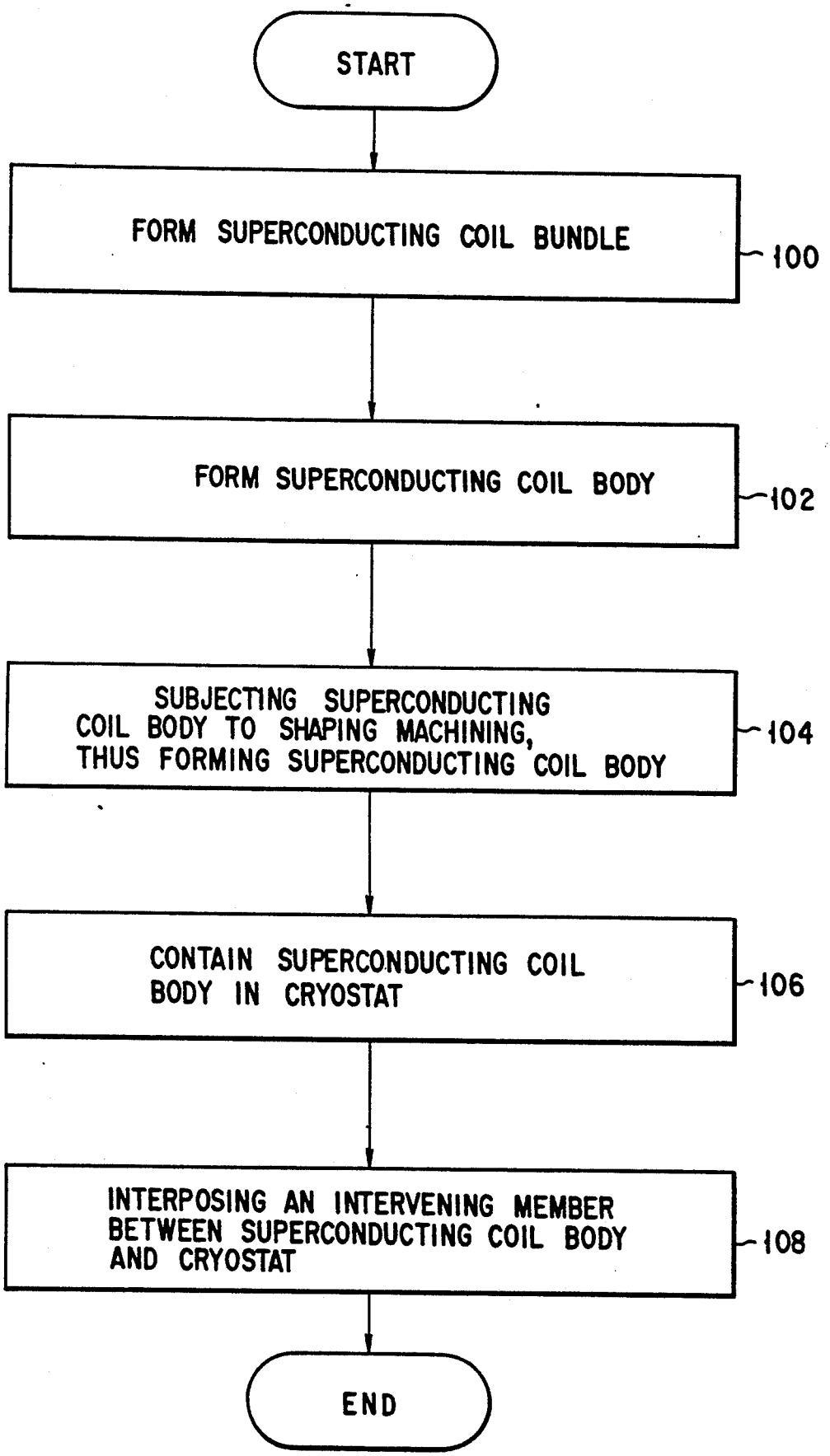
FIG. 11 is a flowchart illustrating a "shaping" method of manufacturing a superconducting coil apparatus, which is a first embodiment of the method of manufacturing the superconducting coil apparatus according to the invention.

A method of manufacturing the superconducting coil apparatus according to the present invention will now be described. The superconducting coil apparatus of this invention can be manufactured by a "shaping" method, "thickening" method, and "thickness adding" method. FIG. 11 illustrates the "shaping" method. In step 100, a superconducting wire or insulating material is subjected to predetermined processing, thereby forming a superconducting coil bundle. In step 102, the superconducting coil bundle is subjected to a curable resin impregnation treatment and a curing treatment, thereby obtaining a superconducting coil body having a resin layer with a uniform thickness on the outside of the superconducting coil. In step 104, the resin layer of the pure superconducting is subjected to a "shaping" process, thereby forming a superconducting coil body having a surface portion consisting of a thick portion and a thin portion on the outside of the superconducting coil. In step 106, the superconducting coil body is contained in a cryostat. Subsequently, in step 108, an interposing member having a function of allowing a coolant to flow between the superconducting coil body and the cryostat and a function of fixing the superconducting coil body within the cryostat is interposed between the thick portion of the superconducting coil body and the cryostat.

Figure 12:
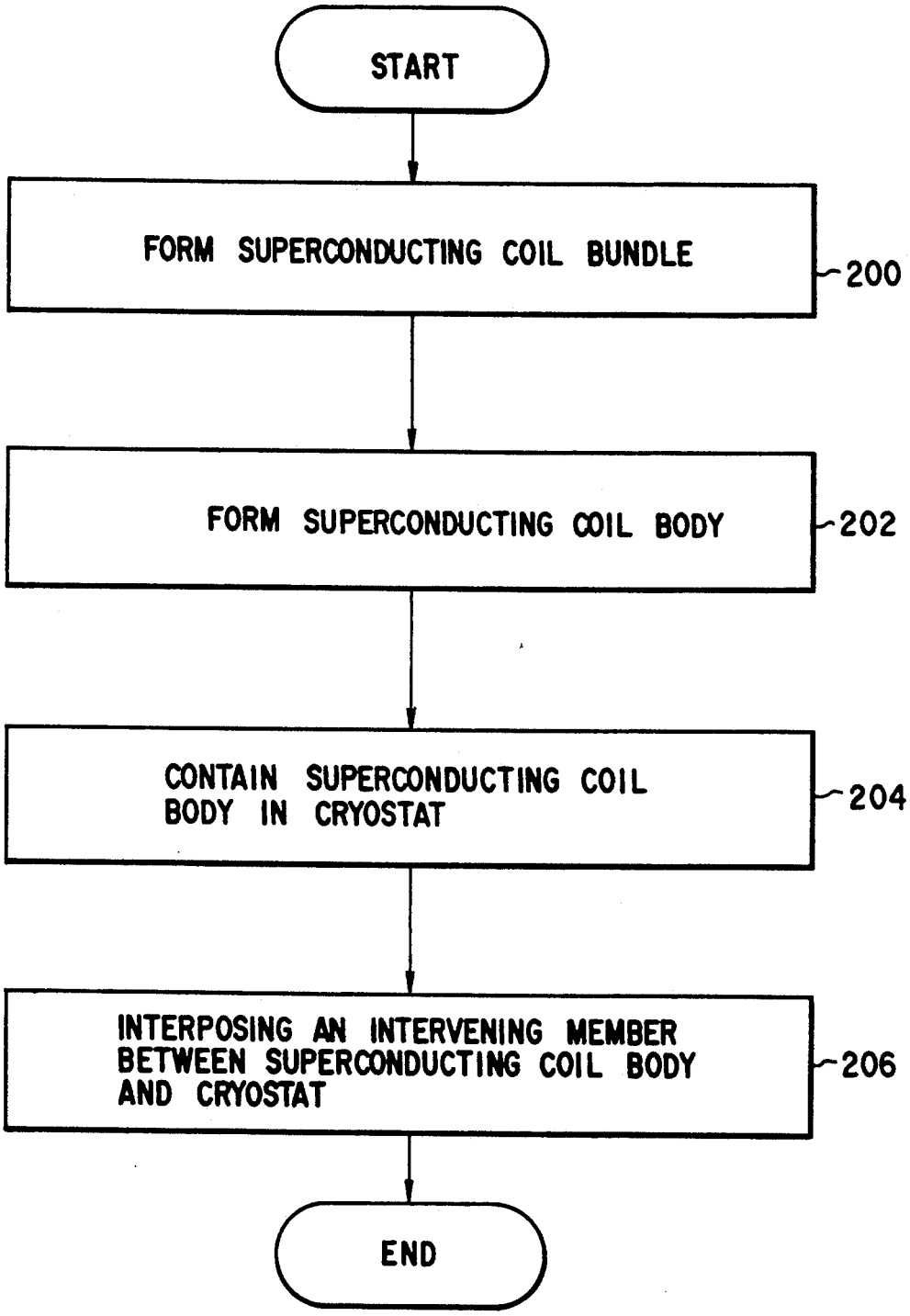
FIG. 12 is a flowchart illustrating a "thickening" method of manufacturing a superconducting coil apparatus, which is a second embodiment of the method of manufacturing the superconducting coil apparatus according to the invention.

FIG. 12 illustrates the "thickening" method. In step 200, a superconducting wire or insulating material is subjected to predetermined processing, thereby forming a superconducting coil bundle. In step 202, the superconducting coil bundle is subjected to a curable resin impregnation treatment and a curing treatment, thereby obtaining a superconducting coil body having an outer surface portion made of a resin layer having a thick portion and a thin portion. In step 204, the superconducting coil body is contained in a cryostat. Subsequently, in step 206, an interposing member having a function of allowing a coolant to flow between the superconducting coil body and the cryostat and a function of fixing the superconducting coil body within the cryostat is interposed between the thick portion of the surface portion of the superconducting coil body and the cryostat.

Figure 13:
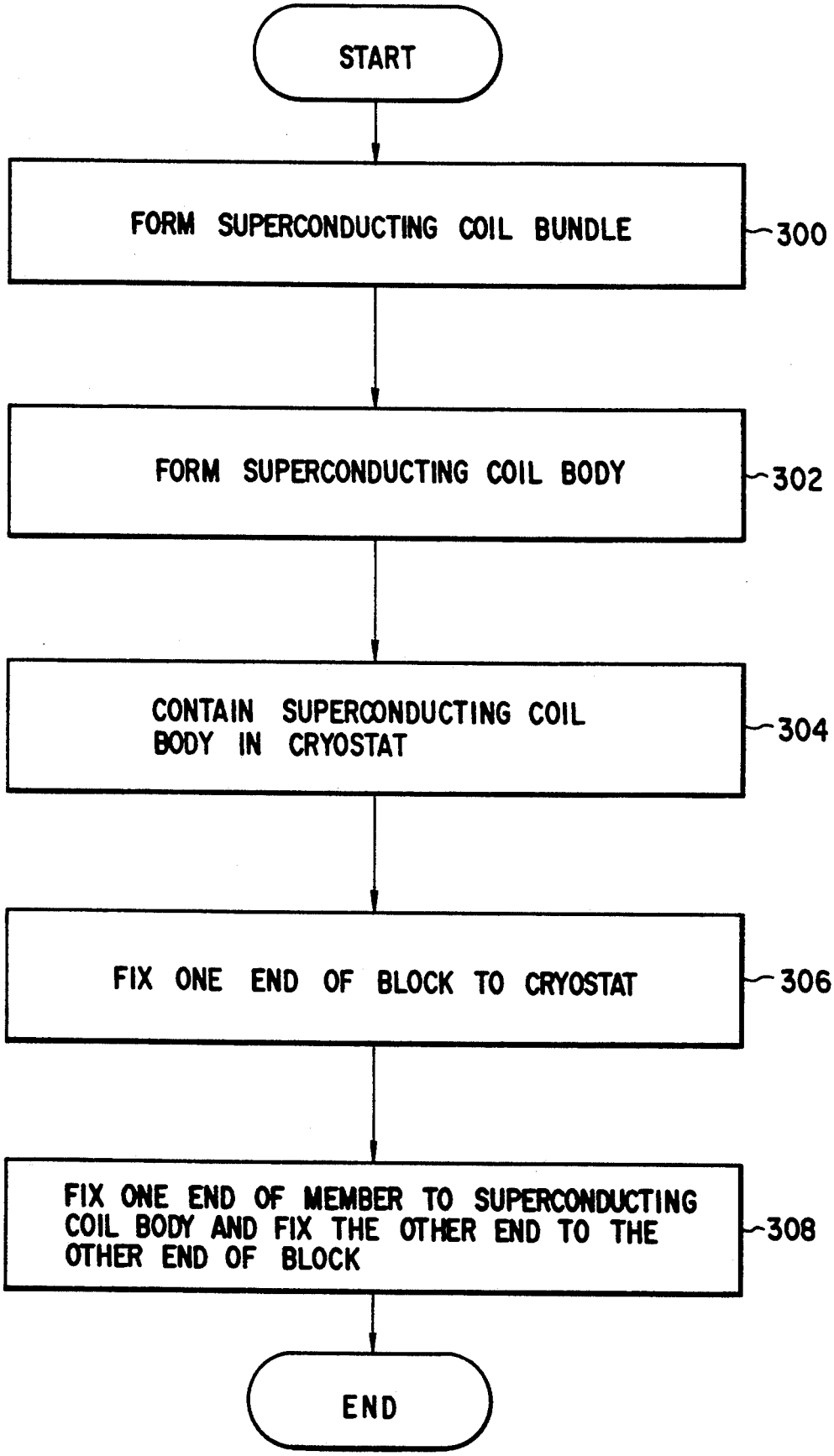
FIG. 13 is a flowchart illustrating a "thickness adding" method of manufacturing a superconducting coil apparatus, which is a third embodiment of the method of manufacturing the superconducting coil apparatus according to the invention.

FIG. 13 illustrates the "thickness adding" method. In step 300, a superconducting wire or insulating material is subjected to predetermined processing, thereby forming a superconducting coil bundle. In step 302, the superconducting coil bundle is subjected to a curable resin impregnation treatment and a curing treatment, thereby obtaining a superconducting coil body having an outer surface portion made of a resin layer having a uniform thickness. In step 304, the superconducting coil body is contained in a cryostat. Subsequently, in step 306, one end portion of a block having a function of flowing a coolant between the superconducting coil body and the cryostat and a function of fixing the superconducting coil body w thin the cryostat is fixed to the cryostat. In step 308, one end portion of a member having substantially the same characteristics as the surface portion is fixed to the surface portion of the superconducting coil body, and the other end portion thereof is supported by the other end portion of the block. FIGS. 9 and 10 show a superconducting coil apparatus which can be manufactured by the "thickness adding" method.

The steps 100, 200 and 300 will now be described in detail. The superconducting coil body is obtained by solidifying the superconducting coil bundle by using resin. The superconducting coil bundle is obtained by subjecting the superconducting wire or insulating material to predetermined treatment. For example, a superconducting wire formed by embodying a Nb-Ti alloy-based superconducting core with copper or the stabilizing material is wound a necessary number of times in a racetrack-shape, with thin insulating layer interposed between windings. The superconducting coil bundle is impregnated with epoxy resin or epoxy resin containing glass fibers as reinforcement material. By solidifying the resultant body, a superconducting coil body is obtained.

Figure 14:
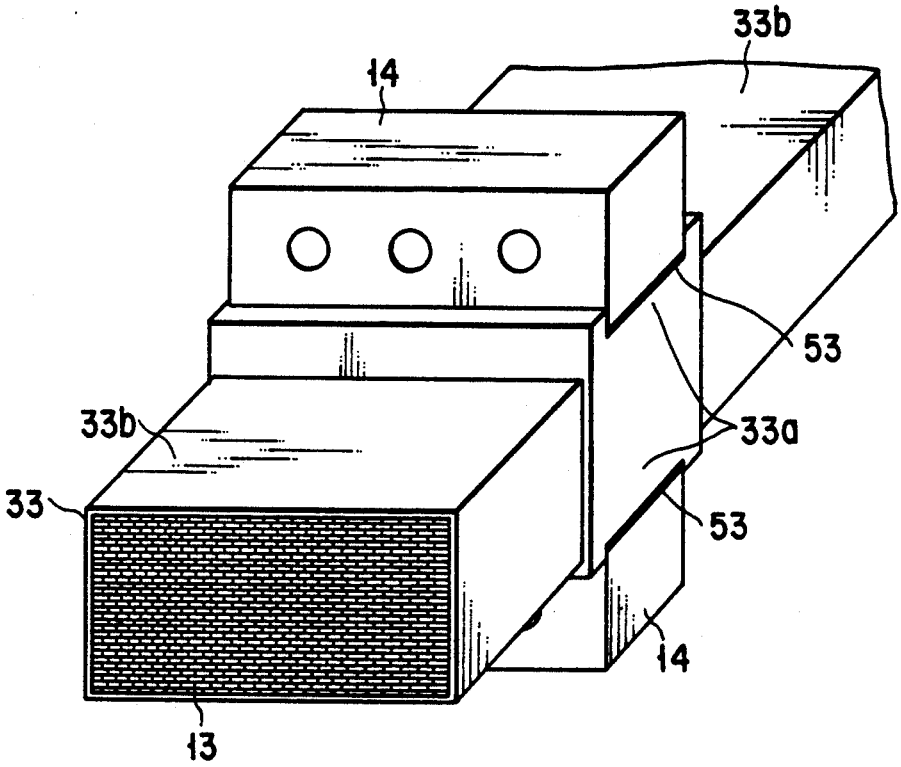
FIG. 14 is a partial perspective view showing an example of a superconducting coil apparatus manufactured by the "shaping" method.

FIG. 14 shows a superconducting coil apparatus manufactured by the "shaping" method. As shown in FIG. 14, the resin layer 33 constituting the surface portion of the superconducting coil body 13 is subjected to the shaping process after the completion of the resin impregnation process, thus forming portions 33*a* of similar shape.

Figure 15:
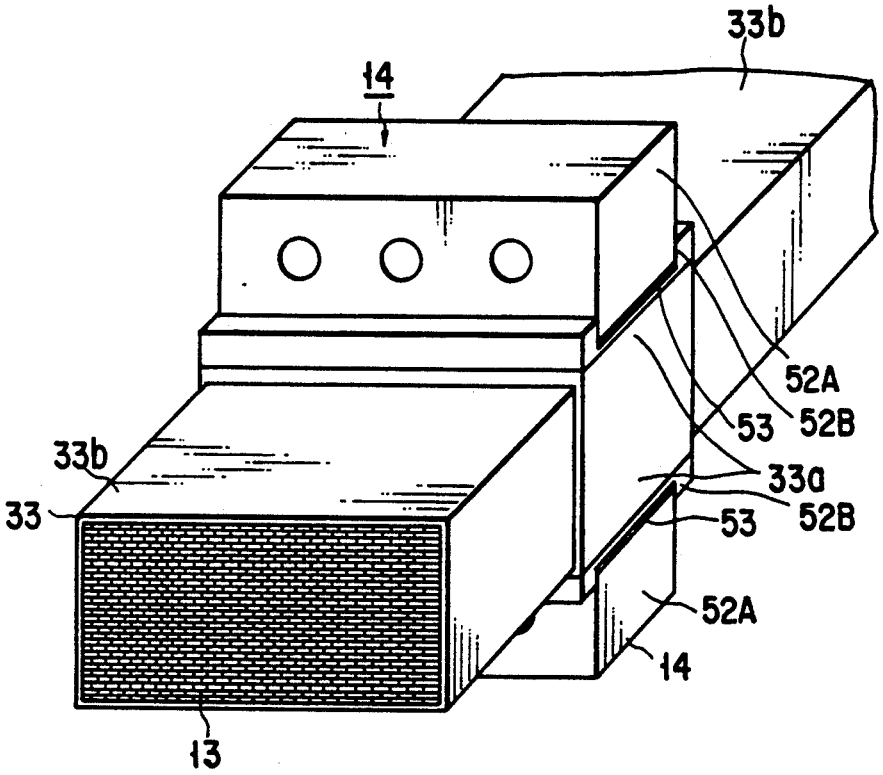
FIG. 15 is a partial perspective view showing another example of a superconducting coil apparatus manufactured basically by the "shaping" method.

FIG. 15 shows a superconducting coil apparatus manufactured by a method based on the cutting method. As shown in FIG. 15, the resin layer 33 constituting the surface portion of the superconducting coil body 13 is subjected to the shaping process after the completion of the resin impregnation process, thus forming portions 33*a* of similar shape. The heat barrier member 52B of the interposing member (fixing member) 52 comprising block 52A and heat barrier member 52B is adhered to the portions 33*a*.

Figure 16:
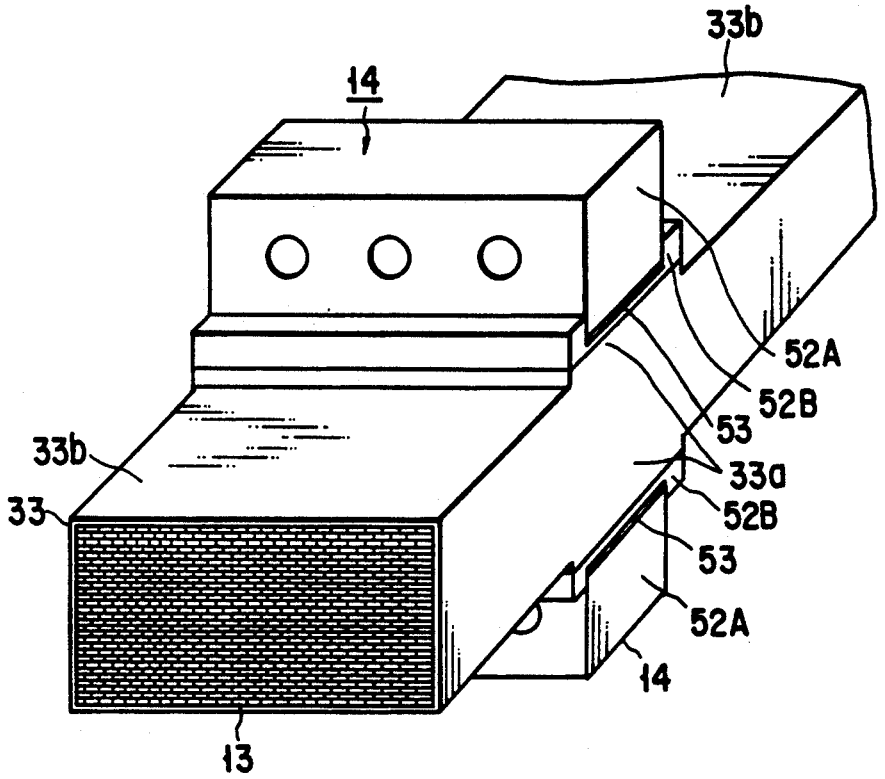
FIG. 16 is a partial perspective view showing an example of a superconducting coil apparatus manufactured basically by the "thickness adding" method.
Figure 17:
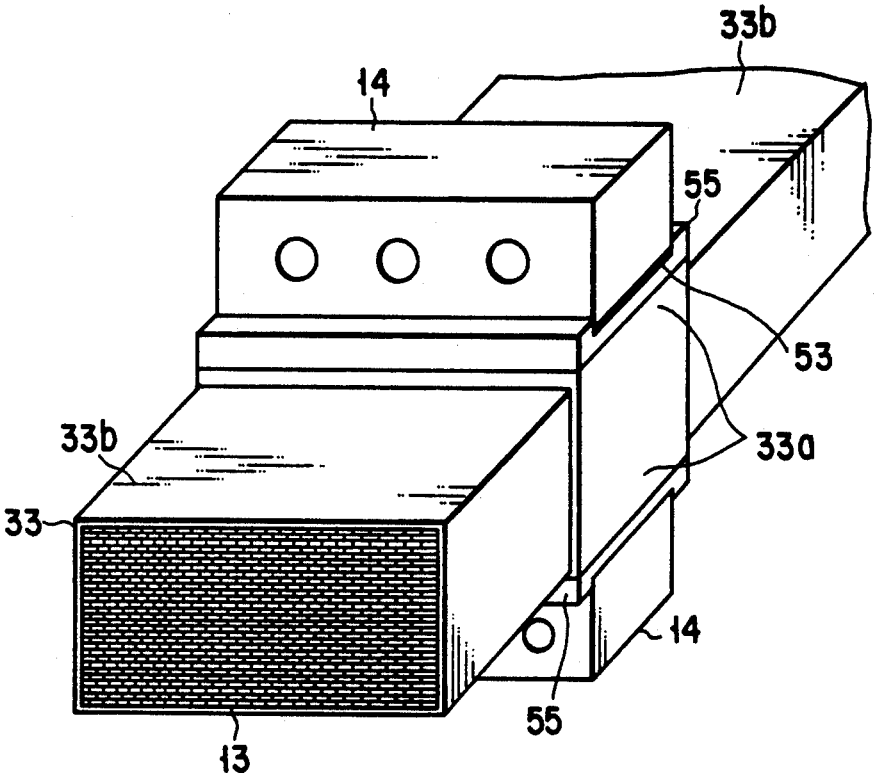
FIG. 17 is a partial perspective view showing an example of a superconducting coil apparatus manufactured basically by the "shaping" method and "thickness adding" method.

FIGS. 16 and 17 show superconducting coil apparatuses manufactured by a method based on the "thickness adding" method. As is shown in FIG. 16, subsequent to the resin impregnation process, the resin layer 33 constituting the surface portion of the superconducting coil body 13 is constructed such that only portions 33A are thicker than the other portions. The heat barrier member 52B of the interposing member (fixing member) 52 comprising block 52A and heat barrier member 52B is adhered to the portions 33*a*. Specifically, when the superconducting coil body 13 is manufactured, the thickness t2 of the resin layer 33 constituting the surface portion is set to less than 0.4 mm uniformly. Thereafter, glass fibers are wound around the portion receiving the fixing member 14. The portion with glass fibers is impregnated with epoxy resin and solidified. The resultant structure is cut, as needed, thereby forming thick portions 33*a*. The superconducting coil body 13 shown in FIG. 17 is constructed such that the thickness t2 of the resin layer constituting the surface portion is set to less than 0.4 mm uniformly. Thereafter, glass fibers are wound around the part supporting the fixing member 14. The part with glass fibers is impregnated with epoxy resin and solidified, and then cut. It is also possible to fix a C-cross sectional heat barrier member 55 on the resultant structure by using an adhesive. In this case, too, it is effective to interpose a solid lubricating member or low-friction sheet 53 between the fixing member 14 and the coil body 13.

In the above embodiments, the superconducting coil body is formed by using an alloy-based superconducting wire; however, it is possible to form the superconducting coil body by using a compound-based superconducting wire or oxide-based superconducting wire. The present invention is applicable to an apparatus wherein a high-stability superconducting wire is employed as a superconducting wire situated near the surface portion, and/or a member with high specific heat is provided outside the superconducting wire situated near the surface portion. Needless to say, this invention is applicable to a coil apparatus for supplying a levitating force for a magnetically levitating train or a coil apparatus of a superconducting generator or superconducting motor.

As has been described above, according to this invention, both the quench due to frictional heat and the quench due to internally generated heat can be prevented without making the structure of the apparatus complex.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A superconducting coil apparatus comprising:

a cryostat having a racetrack-shaped container;

a racetrack-shaped superconducting coil body contained in the container of the cryostat and including an outer surface portion of a resin layer having a thick portion set in a thickness range of 0.4 mm to 3.5 mm and a thin portion set in a thickness less than 0.4 mm; and an interposing member, including a block having at least one through-hole and a spacer, the member interposed between the thick portion of the resin layer and the cryostat and having a function of allowing a coolant to flow between the superconducting coil body and the cryostat and a function of fixing the superconducting coil body within the cryostat.

2. The apparatus according to claim 1, wherein said surface portion is formed of an epoxy resin layer.

3. The apparatus according to claim 1, wherein said surface portion is formed of a glass fiber-reinforced epoxy resin layer.

4. The apparatus according to claim 1, wherein said spacer has a C-cross section.

5. The apparatus according to claim 1, wherein said spacer is formed of fiber-reinforced plastic (FRP).

6. A superconducting coil apparatus comprising:

a cryostat having a racetrack-shaped container;

a racetrack-shaped superconducting coil body contained in the container of the cryostat and including a surface portion of an epoxy resin layer with a uniform thickness;

a block having one end portion fixed to the cryostat and having a function of flowing a coolant between the superconducting coil body and the cryostat and a function of fixing the superconducting coil body within the cryostat; and a member having a C-cross section, fixed at one end to the surface portion of the superconducting coil body and supporting, at the other end, the other end portion of the block, said member having substantially the same characteristics as said surface portion, wherein the total thickness of the surface portion of the superconducting coil body and said member is set in a range of 0.4 mm to 3.5 mm, and the thickness of the surface portion is set less than 0.4 mm.

7. The apparatus according to claim 6, wherein further comprising a friction-reducing member is interposed between said member and said block.

8. A superconducting coil apparatus comprising:

a cryostat having a racetrack-shaped container;

a racetrack-shaped superconducting coil body contained in the container of the cryostat and including an outer surface portion of a resin layer having a thick portion set in a thickness range of 0.4 mm to 3.5 mm and a thin portion set in a thickness less than 0.4 mm; and an interposing member including a block having through-hole, an heat barrier member, and a friction-reducing member interposed between said block and said heat barrier member, interposed between the thick portion of the resin layer and the cryostat and having a function of allowing a coolant to flow between the superconducting coil body and the cryostat and a function of fixing the superconducting coil body within the cryostat.

9. The apparatus according to claim 8, wherein said heat barrier member has a C-cross-section.

10. The apparatus according to claim 8, wherein said heat barrier member is formed by reinforcing a laminated plate with a reinforcing material.

11. The apparatus according to claim 8, wherein said friction-reducing member is a solid lubricating member.

12. The apparatus according to claim 8, wherein said friction-reducing member is a low-friction sheet.

13. The apparatus according to claim 1, wherein:

the thin portion has a thickness of substantially 0.2 mm.

14. The apparatus according to claim 6, wherein:

the surface portion has a thickness of substantially 0.2 mm.

15. The apparatus according to claim 8, wherein:

the thin portion has a thickness of substantially 0.2 mm.

* * * * *